US005756910A

United States Patent [19]

Fields et al.

[11] Patent Number: 5,756,910

[45] Date of Patent: May 26, 1998

[54] METHOD AND APPARATUS FOR ACTUATING SOLENOIDS IN A PLAYER PIANO

[75] Inventors: Kyle D. Fields, El Dorado Hills; George E. McLam, Orangevale; Alana J. Yorba, Carmichael, all of Calif.

[73] Assignee: Burgett, Inc., Sacramento, Calif.

[21] Appl. No.: 770,069

[22] Filed: Dec. 18, 1996

Related U.S. Application Data

[63] Continuation-in-part of Ser. No. 704,331, Aug. 28, 1996, abandoned.

[51] Int. Cl.[6] ..... G10H 7/00

[52] U.S. Cl. ..... 84/20; 84/645

[58] Field of Search ..... 84/19–23, 645

[56] References Cited

U.S. PATENT DOCUMENTS

| | | | |
|---|---|---|---|
| 4,132,141 | 1/1979 | Campbell et al. . | |
| 4,135,428 | 1/1979 | Campbell . | |
| 4,469,000 | 9/1984 | Fujiwara et al. . | |
| 4,500,938 | 2/1985 | Dulin . | |
| 5,022,301 | 6/1991 | Stahnke | 84/21 |
| 5,042,353 | 8/1991 | Stanke . | |
| 5,083,491 | 1/1992 | Fields | 84/21 |
| 5,254,804 | 10/1993 | Tamaki et al. . | |
| 5,276,270 | 1/1994 | Kondo . | |
| 5,432,295 | 7/1995 | Matsunaga et al. . | |
| 5,451,706 | 9/1995 | Yamamoto et al. . | |
| 5,530,198 | 6/1996 | Ishii . | |
| 5,621,603 | 4/1997 | Adamec et al. . | |

FOREIGN PATENT DOCUMENTS

WO 91 06941 A 5/1991 WIPO .

*Primary Examiner*—William M. Shoop, Jr.
*Assistant Examiner*—Jeffrey W. Donels
*Attorney, Agent, or Firm*—John P. O'Banion

[57] ABSTRACT

A method and apparatus for actuating solenoids in an electronic player piano where a Musical Instrument Digital Interface (MIDI) velocity value is translated to a solenoid driving signal, a counter is activated by the solenoid driving signal, and a solenoid is energized from the counter according to the solenoid driving signal. A central processing unit (CPU) reads the MIDI data from a digital data storage device, and selects the corresponding solenoid driving parameters from a look-up table stored in read only memory (ROM). The solenoid driving parameters are converted into a pulse width modulation (PWM) waveform by a driving circuit containing counters. The PWM signal is sent to the gate of a field effect transistor (FET) switch connected to the solenoid and the solenoid is energized by the FET according to the PWM signal.

6 Claims, 5 Drawing Sheets

METHOD AND APPARATUS FOR ACTUATING SOLENOIDS IN A PLAYER PIANO

CROSS REFERENCE TO RELATED APPLICATIONS

This is a continuation-in-part of application Ser. No. 08/704,331 now abandoned, filed on Aug. 28, 1996.

BACKGROUND OF THE INVENTION

1. Field of the Invention

This invention pertains generally to controlling mechanically-driven musical instruments which reproduce pre-recorded music, and more particularly to operation of solenoid actuators using digitally mapped pulse width modulated signals to re-create the expression effects in the original music.

2. Description of the Background Art

Methods and devices for recording and playing back music on mechanically-driven instruments such as pianos are well known. In order to re-create a realistic performance, it is important not only to record the musical notes and timing for later playback, but also to record the expression contained in the original work. The capability to decode recorded expression information and direct that information to the instrument being used to re-create the original work is essential to accurate reproduction of the original work.

In a typical application such as a player piano system, solenoids or other drivers are actuated to strike the strings. Solenoid actuation of a piano key is a complex set of mechanical interactions. The mass of the key mechanism is accelerated by the magnetic force created in the solenoid. Since the force of the solenoid is non-linear because it changes as the plunger travels, and the mass of the key is non-linear because, when actuated, the key damper increases the mass of the key, in order to re-create music with true reproduction of expression effects the solenoid must be dynamically controlled during the entire period of the key strike.

Each of the eighty-eight keys on a typical player piano is actuated by a vertical solenoid working on the far end of the key. The solenoids are arranged so as to lift the end of the key, and thus accelerate the key mechanism and hammer to strike the string. The force produced by the solenoid is non-linear and can vary as much as 10 to 1 from the start to the end of the strike, the shape of the force curve varying according to the solenoid design and construction.

Each piano key includes a damper mechanism which can ride on the key to dampen the string after the strike. The damper interaction takes effect at some point during the key travel, and thus throws an increased mass onto the key when it is engaged. In addition, the damper may be raised by the pianist so that it will not interact with the key, thus allowing the string to sustain after being struck by the hammer.

Each of the solenoid actuators typically consists of a wound coil housed in a steel frame. The solenoid plunger travels within the center of the winding, and exerts mechanical force to lift the piano key. Flexible rubber tips are used between the plunger push-rod and the bottom of the key to reduce the impact noise of the mechanism. However, this also introduces an additional non-linear component into the key travel.

Several techniques and devices have been developed in an attempt to achieve true reproduction, such as activating the solenoids with a stream of pulses and modulating the width of the pulses so that the average drive energy applied to the solenoid is proportional to the desired intensity, adjusting both the leading and trailing edges of pulses in a pulse stream without varying the rate of the pulses so that the pulses switch a solenoid on and off at a rapid rate and the energy applied to the solenoid varies. These approaches, however, use pulse streams to actuate solenoids or other drivers which do not contain sufficient expression information to achieve "true reproduction" of the original work, even though they modulate the width of pulses to vary the average drive energy and striking force. Furthermore, they are not capable of compensating for non-linear travel of the solenoid plungers or the mass of the strike keys differing from instrument to instrument.

A more accurate approach is to map the travel of the solenoid into discrete steps of time, or intervals, where the mapped information takes into account the foregoing non-linear characteristics of solenoid operation and key movement as disclosed in U.S. Pat. No. 5,083,491 owned by the assignee hereof and incorporated by reference herein. Typically, one strike of the solenoid may contain over fifty such intervals. Each of these intervals is selectively activated by a controlling microprocessor, the microprocessor determining the configuration of the map by analysis of various key interactions. The microprocessor, using instructions stored in memory, translates recorded velocity information into driving signals for each solenoid. The driving signals are separated into strike signals and hold signals, the strike signals consisting of time differentiated pulses of fixed width and amplitude, the number and timing of said pulses being dependent upon the information in the drive map which controls the re-creation of the expression of the musical notes. The pulses are then directed to the solenoid which in turn causes the strike hammer to strike the piano string. When the strike period is over, a hold signal which comprises pulses of uniform amplitude and timing are directed to the solenoid so that the strike hammer can be held fixed in place until the end of the musical note. Still, however, re-creation is less than desirable since the pulses are fixed in width and amplitude.

Therefore, there is a need for a method and apparatus for driving solenoids in an electronic player piano using pulse width modulated signals that accurate re-creates the expression of the original recorded work. The present invention satisfies that need, as well as others, and overcomes deficiencies found in prior methods and devices.

SUMMARY OF THE INVENTION

The present invention pertains to a method and apparatus for actuating solenoids in an electronic player piano where superior expression characteristics are achieved. In general terms, a Musical Instrument Digital Interface (MIDI) velocity value is translated to a solenoid driving signal, a counter is activated by the solenoid driving signal, and a solenoid is energized from the counter according to the solenoid driving signal.

By way of example, and not of limitation, the present invention includes a microprocessor unit (MPU) that reads the MIDI data from a digital data storage device. The MPU then selects the corresponding solenoid driving parameters from a look-up table stored in read only memory (ROM). The selected solenoid driving parameters are then translated into a pulse width modulation (PWM) waveform by a driver circuit containing counters. The PWM signal is sent to the gate of a field effect transistor (FET) switch connected to the solenoid and the solenoid is energized by the FET according to the PWM signal.

In the present invention, the driving circuit comprises a plurality of 8-bit solenoid driver counters. Each solenoid driver counter is addressed by the MPU via an interconnected address/data bus and address decoder. The clock rate of each solenoid driver counter is set at 43 kHz which represents the fixed frequency of the PWM signals. A master 8-bit counter, which is also clocked at 43 kHz, controls the maximum duty cycle for all of the solenoid driver counters. To actuate a solenoid, the MPU addresses the particular solenoid's driver counter. A numerical value of from 0 to 255 that is representative of the desired pulse duty cycle is sent to the solenoid driver counter via the interconnected data/address bus. The solenoid driver counter will then start a sequential count, beginning at zero, until it reaches the numerical value it received from the MPU. During the time that the solenoid driver counter is counting, the solenoid is energized. When the solenoid driver counter has reached its pre-loaded count value, the solenoid is turned off and will remain turned off until the master counter has reached a count of 255. In other words, a full duty cycle equals 255 counts. When the master counter reaches a count of 255, solenoid driver counter will be ready to begin a new count to the last number it received upon the next clock period. Note that the solenoid driver counter will only begin its count when the master counter has reset its count to zero after counting to 255. The process is then repeated until a numerical zero is sent to the solenoid driver counter by the MPU. In order to prevent solenoid damage that might occur as a result of lockup, a watchdog timer provides fail safe control of the solenoids by requiring a refresh signal from the MPU every 50 milliseconds. If a refresh signal is not received, the solenoid driver counter will be reset to zero and the power to the solenoid will be turned off. In an alternative embodiment, the clock rate of each solenoid driver counter is set at 8 MHz. A master 8-bit counter, which is also clocked at 8 MHz, controls the maximum duty cycle for all of the solenoid driver counters. Upon power-up or from a hardware reset condition, the master counter will begin counting from 0 to 256. When the master counter reaches a count of 255, an output clear signal is sent to turn off power to the solenoids and a start signal is sent to each of the solenoid driver counters. The master counter will then rollover to 0 just after it reaches a count of 256 and will continue to repeat the count sequence. To actuate a solenoid, the MPU addresses the particular solenoid's driver counter as before. A numerical value of from 0 to 253 that is representative of the desired pulse duty cycle is sent to the solenoid driver counter via the interconnected data/address bus. A zero represents no duty cycle or no power supplied to the solenoids and 253 represents the maximum duty cycle or maximum power supplied to the solenoids. Upon receiving a start signal from the master counter, the solenoid driver counter will then start a sequential count, beginning at the number that was just received, until it reaches a terminal count of 255. During the time that the solenoid driver counter is counting, the solenoid is not energized. The solenoid will then be energized during the period between the time the solenoid driver counter has reached a terminal count of 255 and the time when the master counter sends a start signal to the solenoid driver counters along with an output clear signal to turn off power to the solenoids. Note that the solenoid driver counter will only begin its count when it receives a start signal from the master counter. This occurs when the master counter has rolled over to zero after counting to 256. The counting process is then repeated by the solenoid driver counter using the last number it received from the MPU. This repetition will be interrupted when a new value is sent to the solenoid driver counter from the MPU. In order to prevent solenoid damage that might occur as a result of lockup, a watchdog timer provides fail safe control of the solenoids by requiring a refresh signal from the MPU every 40 milliseconds. If a refresh signal is not received, power to the solenoids will be turned off by sending an output disable signal to the solenoids and a reset signal to the master counter.

The solenoid driving parameters that are stored in ROM are used to generate a pulse width modulated driving signal for each note played. This driving signal comprises three components. The first component, or "pulse" signal, establishes the initial strike velocity. It moves the key and action past statical friction and accelerates the hammer toward the string. The second component, or "trough" signal, continues the key motion to commit the hammer to strike the string at a force lower than the "pulse" signal without increasing the velocity of the key. The third component, or "clamp" signal, maintains the hammer against the string to prevent recoil of the hammer from the string and varies linearly from faster time to slowest time in 128 steps.

An object of the invention is to accurately re-create recorded music on a solenoid actuated musical instrument.

Another object of the invention is to compensate for the impact of non-linear travel of solenoid plungers operating strike hammers in a player piano system.

Another object of the invention is to compensate for the impact of non-linear mass of piano keys on accurate music reproduction.

Another object of the invention is to compensate for the impact of noise dampers on accurate music reproduction.

Another object of the invention is to actuate solenoids in a player piano system with pulse width modulated data pulses which dynamically control the solenoid position during the entire strike time.

Another object of the invention is to maximize striking force with minimum power dissipation.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
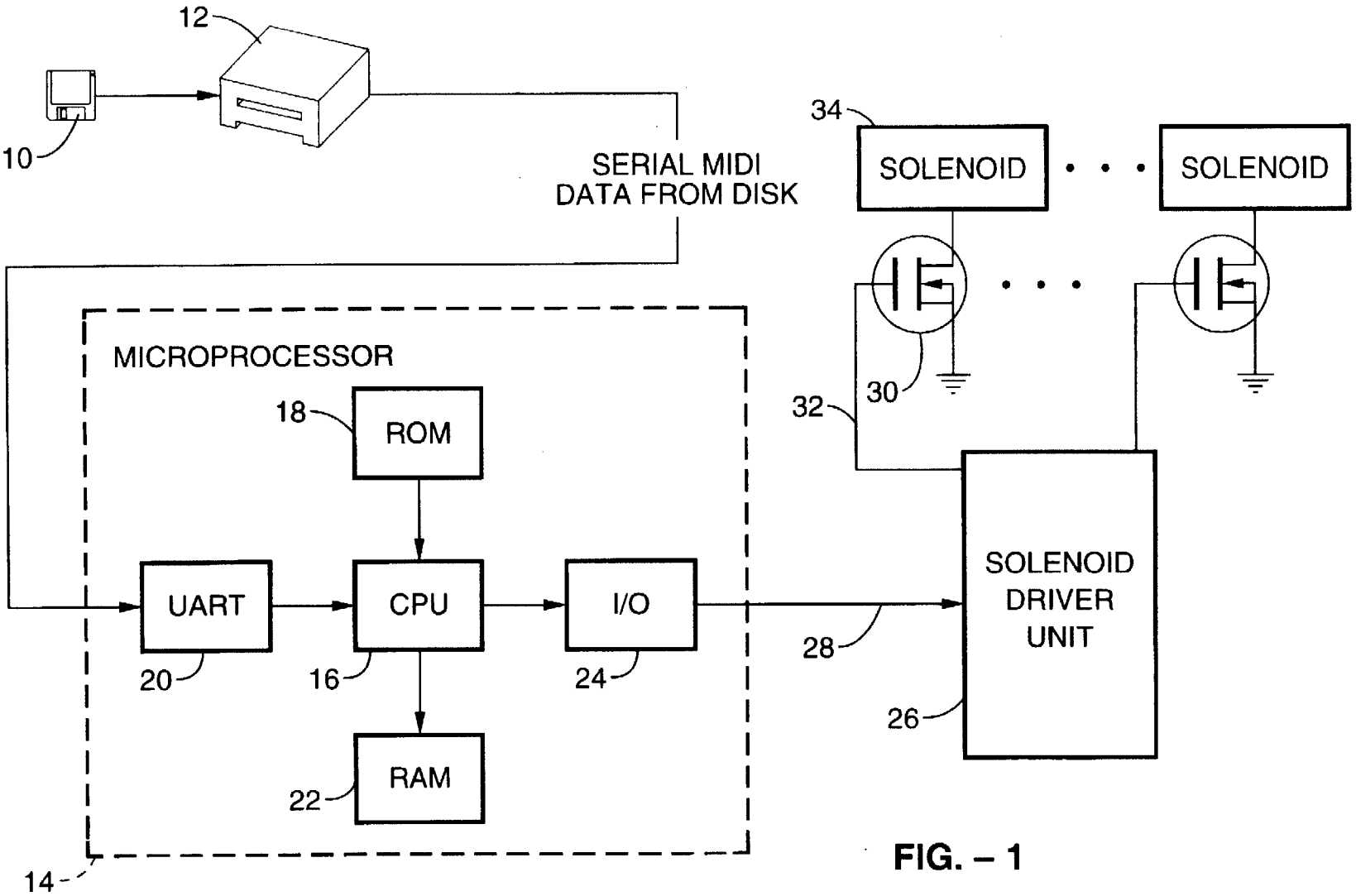
FIG. 1 is functional block diagram of an apparatus for activating solenoids in accordance with the present invention.
Figure 2:
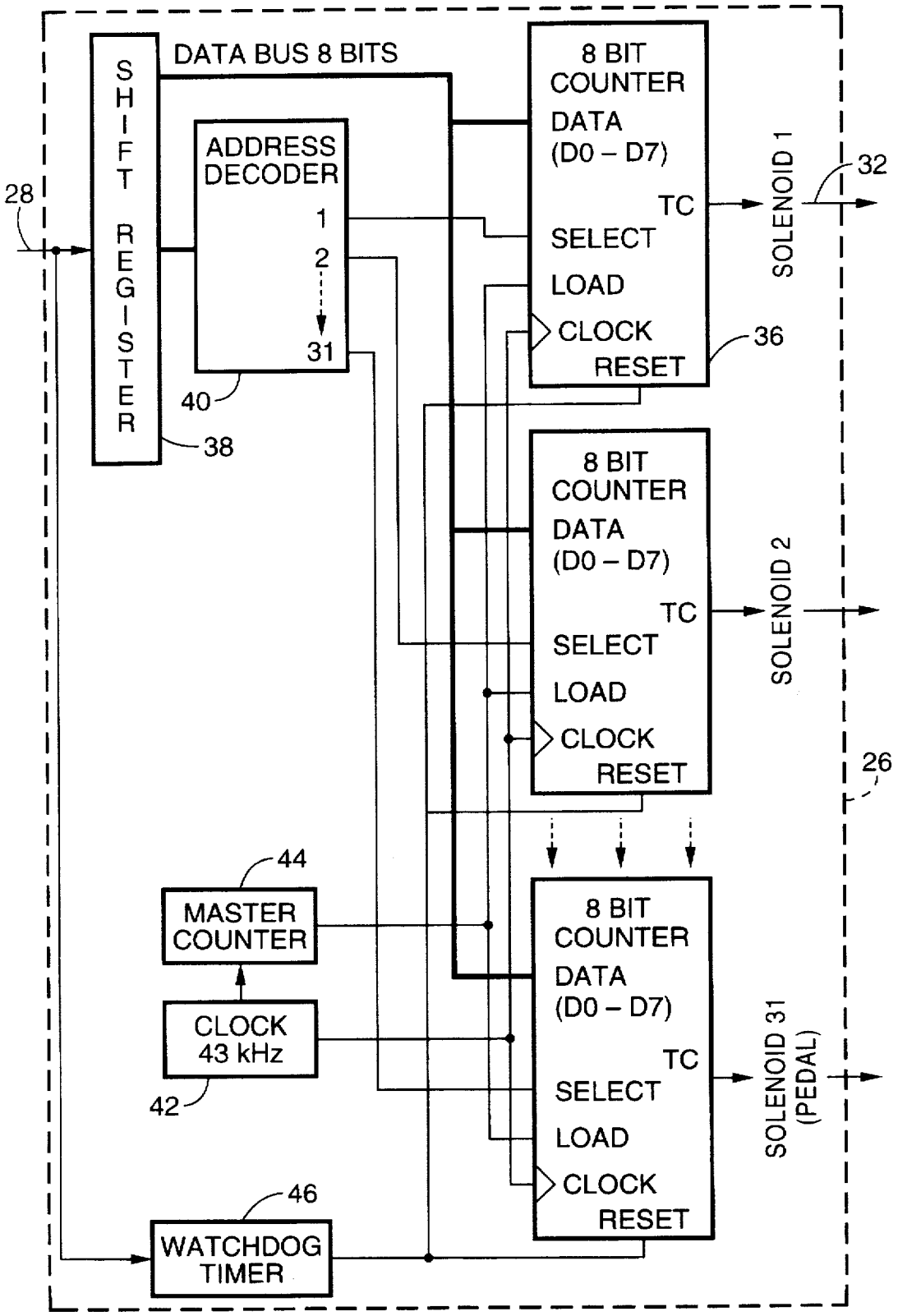
FIG. 2 is a functional block diagram of the solenoid driver circuit portion of the apparatus shown in FIG. 1.

Referring more specifically to the drawings, for illustrative purposes the present invention is embodied in the apparatus generally shown in FIG. 1 through FIG. 2. It will be appreciated that the apparatus may vary as to configuration and as to details of the parts and that the method may vary as to the steps and their sequence without departing from the basic concepts as disclosed herein.

The present invention utilizes musical information recorded on magnetic disk in Musical Instrument Digital Interface (MIDI) format which has become an industry standard. Once musical information is recorded in MIDI, the information can be manipulated by a computer using standard editing techniques. For example, sections of the music can be duplicated, bad notes can be corrected, and any other desired musical operation can be performed.

MIDI is a serial communications standard that provides a common language for the transmission of musical events in real time. The MIDI specification allows up to sixteen channels of information to be carried by a single cable, and each channel contains data about what notes are to be played, how loud they will be, what sounds will be used and how the music will be phrased. Contained within these data channels are velocity factors which are coded from 0 to 128, the highest velocity corresponding to the highest velocity factor. The present invention utilizes those velocity factors to accurately re-create the expression of the original recorded music on a solenoid actuated musical instrument such as a player piano system.

Referring to FIG. 1, in the preferred embodiment of the invention recorded media 10 containing music to be reproduced is read by playback unit 12. Media 10 can be any conventional magnetic or optical storage media or the like, and playback unit 12 can be any corresponding conventional media reader. Coupled to playback unit 12 is control microprocessor unit (MPU) 14 which selects the solenoid driving parameters for each driving signal corresponding to a particular velocity factor. A core element of MPU 14 is CPU 16, a central processor at the heart of the system. Coupled to CPU 16 is ROM 18, which contains in read only memory the solenoid driving parameters for the various velocity factors as well as the operating software for CPU 16. Also coupled to CPU 16 is UART 20, a serial data receiver which receives the serial MIDI data from playback unit 12 and routes it to CPU 16. RAM 22, which contains changeable program data, is also coupled to CPU 16, as are I/O drivers 24 which couple MPU 14 to a solenoid driving circuit 26 through an address/data bus 28. Solenoid driver circuit 26 then converts the solenoid driving parameters into a pulse width modulated signal which drives one of several FET drivers 30 through a corresponding control line 34. The FET driver 30 in turn activates a corresponding solenoid 34 through a control line 36. MPU 14 is typically a Dallas Semiconductor DS87C520 or the like, and conventional circuitry and circuit elements are utilized throughout.

Referring also to FIG. 2, MPU 14 decodes a note and corresponding velocity factor from the recorded media 10 and assigns a particular driving signal to that velocity factor as discussed below. The note data will determine which of the solenoids 34 will be activated by solenoid driver circuit 26, and the driving signal will re-create the expression of the note played. Solenoid driver circuit 26, which is preferably in the form of an application specific integrated circuit (ASIC), typically includes thirty-one individually addressable 8-bit solenoid driver counters 36. Each solenoid driver counter 36 is addressed by MPU 14 via the interconnected address/data bus 28 through a shift register 38 and address decoder 40. The clock rate of each solenoid driver counter 36 is set at 43 kHz by a clock 42 which represents the fixed frequency of the PWM signals. To actuate a particular solenoid 34, control MPU 14 addresses the solenoid driver counter 36 associated with that solenoid and sends a count from 0 to 255 that is representative of the desired pulse duty cycle. This data is received by shift register 40 via address/data bus 28. The count data is transferred to a common data bus, and the particular solenoid driver counter that will act on the data is selected by address decoder 40.

A master 8-bit counter 44 controls the maximum duty cycle for all of the solenoid driver counters 36. Master counter 44 is also clocked at 43 kHz by clock 42 and counts continuously from 0 to 255. In other words, a full duty cycle is 255 counts. Each time that master counter 44 completes a full duty cycle, it outputs a load signal to strobe the solenoid driver counters 36. The solenoid driver counter 36 that was addressed then begins a sequential count from zero. While solenoid counter driver 36 is counting, solenoid 34 is energized by its corresponding FET driver 30. Then, when the solenoid driver counter 36 has reached its pre-loaded count value, solenoid 34 is turned off and will remain turned off until the master counter 44 finishes counting to 255. When master counter 44 has reset its count to zero, it will again strobe the solenoid driver counters. The selected solenoid driver counter 36 will begin counting from zero to the count that has been sent over the data bus. Note that the solenoid driver counter 36 will only begin its count when the master counter has reset its count to zero after counting to 255. Not only does this set the duty cycle of the solenoid driver counter 36 but maintains synchronization between master counter 44 and solenoid driver counter 36.

The foregoing process of counting and providing power to the solenoid 34 will continue until a numerical zero is sent to solenoid driver counter 36 by MPU 14 when overall the time has reached the time value associated with the MIDI code. However, in order to prevent solenoid damage that might occur as a result of lockup, a watchdog timer 46 can be employed to provide a fail safe control of the solenoids. Watchdog timer 46 requires a refresh signal from MPU 14 every 50 ms and, if the refresh signal is not received, all of the solenoid driver counters will be reset to zero.

Figure 3:
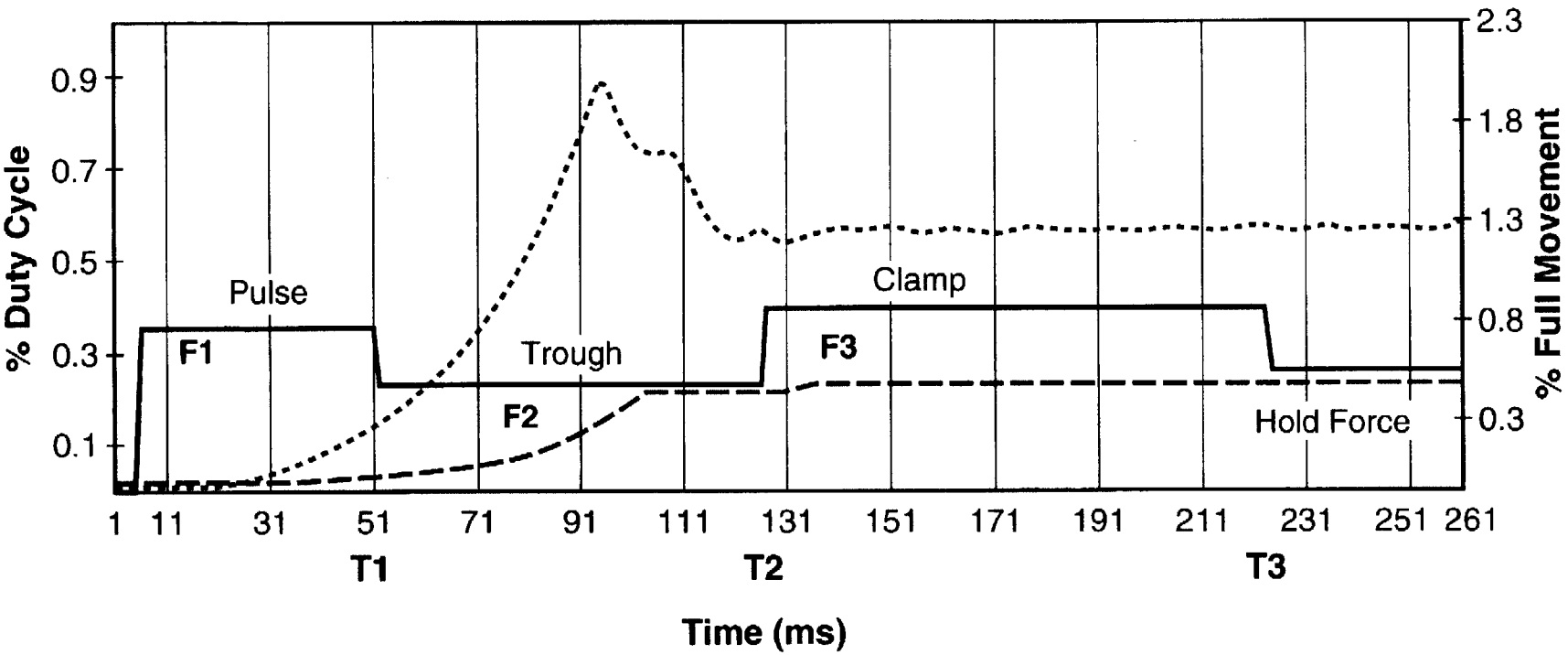
FIG. 3 is a graph showing the relationship between key movement, hammer movement, and driving signal waveforms according in accordance with the present invention.

FIG. 3 shows an example of a "correct expression" driving waveform and the resultant key and hammer movement. The left vertical scale corresponds to driving force in percent duty cycle, the right vertical scale corresponds to key and hammer position as a percent of full movement, and the x-axis corresponds to time in milliseconds. The solid line represents the driving signal, the dashed line represents key motion, and the dotted line represents hammer motion. Ideally, the key reaches fully depressed just before the clamp pulse voltage arrives. In this circumstance, the hammer strikes the string cleanly and then the key clamps it in place until holding occurs. Key and hammer travel is shown as a function of the driving voltage waveform that has components denoted as F1 (pulse), F2 (trough) and F3 (clamp). The graph shows how the mechanical response of the key fits with the nominal voltage waveform applied to the solenoid. If there is a mismatch in timing between the response of the key and the electrical signal to the solenoid, different sound faults will occur. If the voltage level is too low or the time too short to allow the hammer to respond to the low MIDI velocity there may be no strike, a weak strike or a harder strike caused by the clamp pulse adding to the strike force.

The solenoid driving parameters that are stored in ROM are used to create the solenoid driving signal that has the three components shown in FIG. 3. The first component, or "pulse" voltage signal, establishes the initial strike velocity. This signal, which has a duration of time T1 and force of F1, moves the key and action past statical friction and accelerates the hammer toward the string. The component, or "trough" voltage signal, continues the key motion to commit the hammer to strike the string at a force lower than the "pulse" signal without increasing the velocity of the key. This signal has a duration of time T2 and a force of F2. The third component, or "clamp" voltage signal, maintains the hammer against the string to prevent recoil of the hammer from the string and varies linearly from faster time to slowest time in 128 steps. This signal has a duration of time T3 and a force of F3.

Time T1 is a constant value determined as the time that force F1 takes to get the hammer past the piano action let-off but before the hammer strikes the string. This equates to the hammer getting within approximately one inch of striking the string. Time T2 is the minimum time for force F2 to get the hammer to strike the string and make the softest possible sound. If time T2 is too small, the note will be too loud. Time T3 is the total event time given to actuate a key during a hammer strike of the string.

Force F1, F2 and F3 vary as the squared function from a minimum to maximum value. Therefore, where a minimum voltage minV is required to drive the solenoid:

$$F1 \text{ minimum}=\text{min}V+\text{pulse}$$

$$F2 \text{ minimum}=\text{min}V+\text{trough}$$

$$F3 \text{ minimum}=\text{min}V+\text{clamp}$$

where pulse, clamp and trough are constants. Similarly, where the maximum solenoid driving voltage is maxV, $$F1 \text{ maximum}=\text{max}V+\text{pulse}$$

$$F2 \text{ maximum}=\text{max}V+\text{trough}$$

$$F3 \text{ maximum}=\text{max}V+\text{clamp}$$

Between the minimum and maximum force values is a force value Fx which is related to a MIDI velocity x according to:

$$Fx=ax^2+bx^2+c$$

where, a=curve value constant/$127^2$ b=(maxV−minV−curve value constant)×127 c=minV then for a particular MIDI value $$F1 \text{ of } MIDI=Fx+\text{pulse}$$

$$F2 \text{ of } MIDI=Fx+\text{trough}$$

$$F3 \text{ of } MIDI=Fx+\text{clamp}$$

where clamp=trough for MIDI levels less than 85 and clamp equals a constant for MIDI levels greater than 85. The curve value constant is an empirical value used to tailor an expression table to the different types of pianos on the market, and can typically range from 1.45 for upright pianos to 1.85 for grand pianos.

Table 1 gives an example of a typical expression table that would be stored in ROM as a lookup table. Typically, there would be three expression tables (e.g., base, tenor and light sections of the keyboard) developed for every known combination of piano action and style (e.g., a grand piano with light action, grand with heavy action, upright with light action, etc.). Note that Table 1 contains six columns containing data values for each MIDI velocity factor. The time values T1, T2 and T3 are in units of 5 ms. For example, a value of 10 for T1 would equal a time period of 50 ms. The force values F1, F2 and F3 are the counts that are sent to the solenoid driver counters and represent percentages of a full duty cycle, where a full duty cycle equals 255 counts and each count equals 5 ms. Therefore, a full duty cycle of 255 counts would equal 1275 ms. The PWM signal represented by a particular force value, F1, F2 or F3, is only sent to a solenoid during its respective time period defined by T1, T2 or T3. Note also that the values given for T1, T2 and T3 in the expression table do not represent individual time duration values but cumulative points in time with reference to zero. For example, if T1=10, T2=24 and T3=31, the timing would be as follows: T1=0 to 50 ms, T2=51 to 120 ms, and T3=121 to 155 ms. The associated duration values would be the increment over the previous value. For example, the duration value corresponding to T1 would be T1−0 or 50 ms; to T2 would be T2−T1 or 120 ms−50 ms=70 ms; and to T3 would be T3−T2 or 155 ms−120 ms=35 ms.

It will be appreciated that a typical piano includes eighty-eight keys and three pedals. Therefore, for a full piano installation three solenoid driver circuits 26 would be employed and would share a common input/output (I/O) bus. In each solenoid driver circuit 26, the first thirty solenoid driver counters would be associated with thirty of the eighty-eight piano keys and the thirty-first would be associated with one of the three pedals. For simplicity, the discussion herein has referred to the operation of a single solenoid driver circuit 26 since operation is the same for each.

Figure 4:
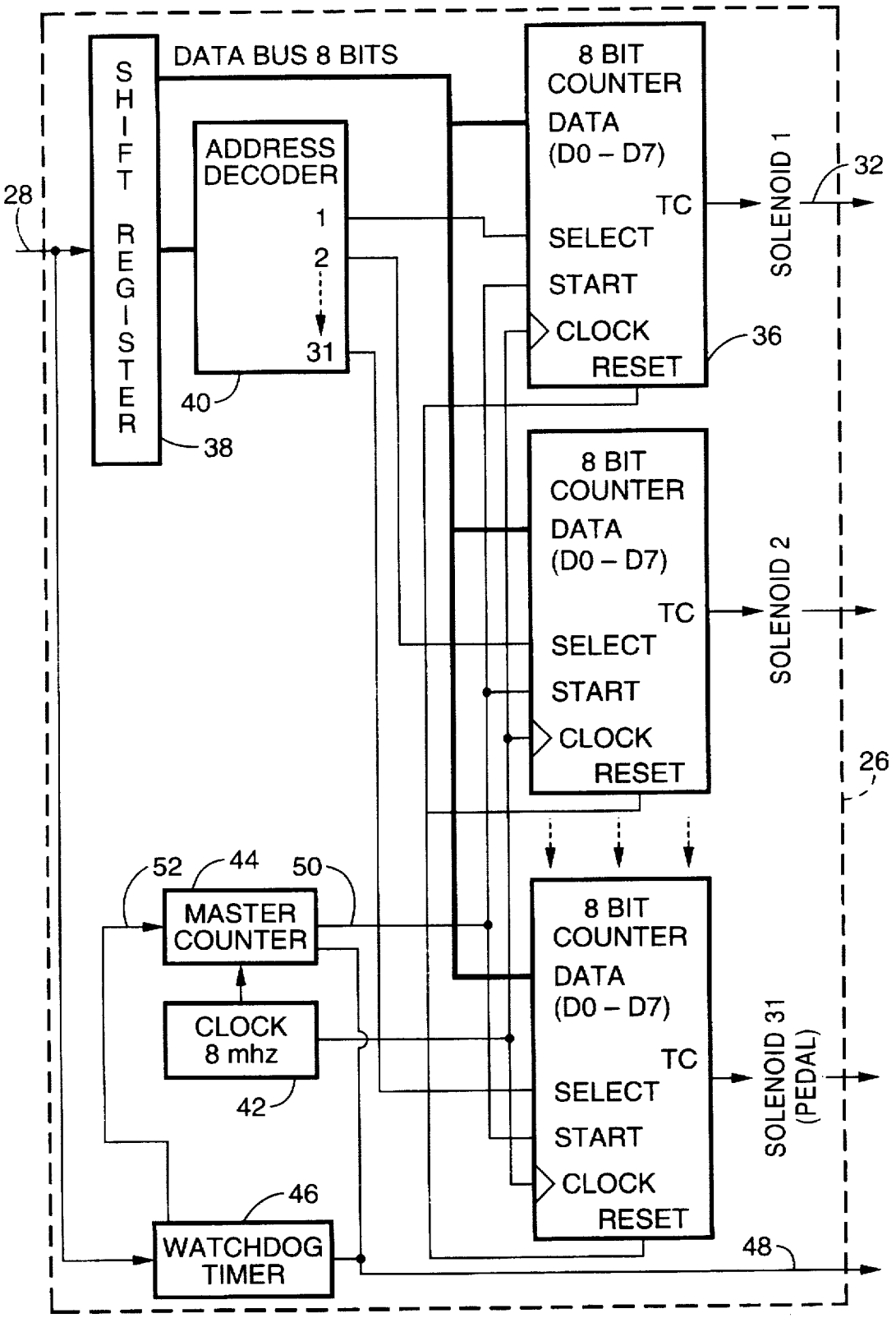
FIG. 4 is a functional block diagram of an alternative embodiment of the solenoid driver shown in FIG. 2.

Referring now to FIG. 4, where like reference numerals denote like parts, an alternative embodiment of the solenoid driver circuit shown in FIG. 2 can be seen. In this embodiment, the clock rate of each solenoid driver counter 36 is set at 8 MHz by clock 42. To actuate a particular solenoid 34, MPU 14 addresses the solenoid driver counter 36 associated with that solenoid and sends a count from 0 to 253 that is representative of the desired pulse duty cycle. This data is received by shift register 40 via address/data bus 28. The count data is transferred to the common data bus, and the particular solenoid driver counter 36 that will act on the data is selected by address decoder 40.

Figure 5:
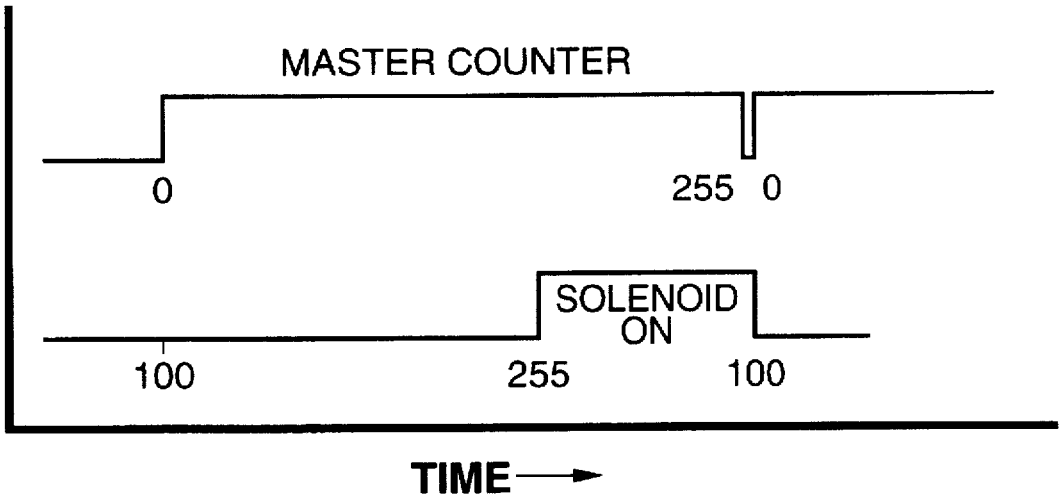
FIG. 5 is a sample timing diagram for the solenoid driver circuit shown in FIG. 4.

Master 8-bit counter 44, which is also clocked at 8 MHz by clock 42, controls the maximum duty cycle for all of the solenoid driver counters 36. Upon power-up or from a hardware reset condition, master counter 44 will begin counting from 0 to 256. When master counter 44 reaches a count of 255, an output clear signal is sent through disable line 46 to turn off power to the solenoid FET drivers 30, and a start signal is sent to each of the solenoid driver counters 36 through start line 48. Master counter 44 will then rollover to 0 just after it reaches a count of 256 and will continue to repeat the count sequence. To actuate a solenoid 34, MPU 14 addresses the particular solenoid's driver counter 36 as before. A numerical value of from 0 to 253 that is representative of the desired pulse duty cycle is then sent to the selected solenoid driver counter 36 via the interconnected data/address bus. A zero represents no duty cycle or no power supplied to the solenoid 34 and 253 represents the maximum duty cycle or maximum power supplied to the solenoid. Upon receiving a start signal from master counter 44, the selected solenoid driver counter 36 will then start a sequential count, beginning at the number that was just received, until it reaches a terminal count of 255. During the time that the solenoid driver counter 36 is counting, the corresponding solenoid 34 is not energized. The solenoid 34 will then be energized during the period between the time the solenoid driver counter 36 has reached a terminal count of 255 and the time when master counter 44 sends a start signal to the solenoid driver counter along with an output clear signal to turn off power to the solenoid. Note that the solenoid driver counter 36 will only begin its count when it receives a start signal from master counter 44. This occurs when master counter 44 has rolled over to zero after counting to 256. The counting process is then repeated by the solenoid driver counter 36 using the last number it received from MPU 14. This repetition will be interrupted when a new value is sent to the solenoid driver counter 36 from MPU 14. An exemplary timing diagram where a solenoid driver counter is loaded with the value "100" is shown in FIG. 5.

In order to prevent solenoid damage that might occur as a result of lockup, watchdog timer 46 provides fail safe control of the solenoids by requiring a refresh signal from MPU 14 every 40 milliseconds. If a refresh signal is not received, power to the solenoids 34 will be turned off by watchdog timer 46 sending an output disable signal to the solenoids through output disable line 48 and a reset signal to master counter 44 through reset line 52.

Accordingly, it will be seen that this invention presents a unique and innovative solenoid drive technique, and allows for true re-creation of musical expression, lower costs of manufacture, better compliance with design standards, and increased reliability. Although the description above contains many specificities, these should not be construed as limiting the scope of the invention but as merely providing illustrations of some of the presently preferred embodiments of this invention. Thus the scope of this invention should be determined by the appended claims and their legal equivalents.

TABLE 1

| Velocity Factor | T1 | T2 | T3 | F1 | F2 | F3 |
|---|---|---|---|---|---|---|
| 0 | 0 | 0 | 150 | 0 | 0 | 0 |
| 1 | 10 | 26 | 32 | 89 | 59 | 59 |
| 2 | 10 | 26 | 32 | 90 | 59 | 59 |
| 3 | 10 | 26 | 32 | 90 | 60 | 60 |
| 4 | 10 | 25 | 32 | 91 | 60 | 60 |
| 5 | 10 | 25 | 32 | 91 | 61 | 61 |
| 6 | 10 | 25 | 32 | 92 | 61 | 61 |
| 7 | 10 | 25 | 31 | 92 | 62 | 62 |
| 8 | 10 | 25 | 31 | 93 | 62 | 62 |
| 9 | 10 | 25 | 31 | 94 | 63 | 63 |
| 10 | 10 | 25 | 31 | 94 | 63 | 63 |
| 11 | 10 | 24 | 31 | 95 | 64 | 64 |
| 12 | 10 | 24 | 31 | 95 | 65 | 64 |
| 13 | 10 | 24 | 30 | 96 | 65 | 65 |
| 14 | 10 | 24 | 30 | 96 | 66 | 66 |
| 15 | 10 | 24 | 30 | 97 | 66 | 66 |
| 16 | 10 | 24 | 30 | 97 | 67 | 67 |
| 17 | 10 | 24 | 30 | 98 | 67 | 67 |
| 18 | 10 | 24 | 30 | 98 | 68 | 68 |
| 19 | 10 | 23 | 29 | 99 | 68 | 68 |
| 20 | 10 | 23 | 29 | 99 | 69 | 69 |
| 21 | 10 | 23 | 29 | 100 | 69 | 69 |
| 22 | 10 | 23 | 29 | 100 | 70 | 70 |
| 23 | 10 | 23 | 29 | 101 | 70 | 70 |
| 24 | 10 | 23 | 29 | 101 | 71 | 71 |
| 25 | 10 | 23 | 29 | 102 | 71 | 71 |
| 26 | 10 | 23 | 28 | 103 | 72 | 72 |
| 27 | 10 | 22 | 28 | 103 | 72 | 72 |
| 28 | 10 | 22 | 28 | 104 | 73 | 73 |
| 29 | 10 | 22 | 28 | 104 | 74 | 74 |
| 30 | 10 | 22 | 28 | 105 | 74 | 74 |
| 31 | 10 | 22 | 28 | 105 | 75 | 75 |
| 32 | 10 | 22 | 27 | 106 | 75 | 75 |
| 33 | 10 | 22 | 27 | 106 | 76 | 76 |
| 34 | 10 | 22 | 27 | 107 | 76 | 76 |
| 35 | 10 | 21 | 27 | 107 | 77 | 77 |

TABLE 1-continued

| Velocity Factor | T1 | T2 | T3 | F1 | F2 | F3 |
|---|---|---|---|---|---|---|
| 36 | 10 | 21 | 27 | 108 | 77 | 77 |
| 37 | 10 | 21 | 27 | 108 | 78 | 78 |
| 38 | 10 | 21 | 26 | 109 | 78 | 78 |
| 39 | 10 | 21 | 26 | 109 | 79 | 79 |
| 40 | 10 | 21 | 26 | 110 | 79 | 79 |
| 41 | 10 | 21 | 26 | 110 | 80 | 80 |
| 42 | 10 | 21 | 26 | 111 | 80 | 80 |
| 43 | 10 | 20 | 26 | 112 | 81 | 81 |
| 44 | 10 | 20 | 25 | 112 | 81 | 81 |
| 45 | 10 | 20 | 25 | 113 | 82 | 82 |
| 46 | 10 | 20 | 25 | 113 | 83 | 83 |
| 47 | 10 | 20 | 25 | 114 | 83 | 83 |
| 48 | 10 | 20 | 25 | 114 | 84 | 84 |
| 49 | 10 | 20 | 25 | 115 | 84 | 84 |
| 50 | 10 | 20 | 25 | 115 | 85 | 85 |
| 51 | 10 | 19 | 24 | 116 | 85 | 85 |
| 52 | 10 | 19 | 24 | 116 | 86 | 86 |
| 53 | 10 | 19 | 24 | 117 | 86 | 86 |
| 54 | 10 | 19 | 24 | 117 | 87 | 87 |
| 55 | 10 | 19 | 24 | 118 | 87 | 87 |
| 56 | 10 | 19 | 24 | 119 | 88 | 88 |
| 57 | 10 | 19 | 23 | 120 | 89 | 89 |
| 58 | 10 | 19 | 23 | 120 | 90 | 90 |
| 59 | 10 | 18 | 23 | 121 | 91 | 91 |
| 60 | 10 | 18 | 23 | 122 | 92 | 92 |
| 61 | 10 | 18 | 23 | 123 | 92 | 92 |
| 62 | 10 | 18 | 23 | 124 | 93 | 93 |
| 63 | 10 | 18 | 22 | 125 | 94 | 94 |
| 64 | 10 | 18 | 22 | 126 | 95 | 95 |
| 65 | 10 | 18 | 22 | 127 | 96 | 96 |
| 66 | 10 | 17 | 22 | 128 | 97 | 97 |
| 67 | 10 | 17 | 22 | 129 | 98 | 98 |
| 68 | 10 | 17 | 22 | 130 | 99 | 99 |
| 69 | 10 | 17 | 22 | 131 | 100 | 100 |
| 70 | 10 | 17 | 21 | 132 | 101 | 101 |
| 71 | 10 | 17 | 21 | 133 | 102 | 102 |
| 72 | 10 | 17 | 21 | 134 | 103 | 103 |
| 73 | 10 | 17 | 21 | 135 | 104 | 104 |
| 74 | 10 | 16 | 21 | 136 | 105 | 105 |
| 75 | 10 | 16 | 21 | 137 | 106 | 160 |
| 76 | 10 | 16 | 20 | 138 | 107 | 161 |
| 77 | 10 | 16 | 20 | 139 | 108 | 162 |
| 78 | 10 | 16 | 20 | 140 | 109 | 163 |
| 79 | 10 | 16 | 20 | 141 | 110 | 164 |
| 80 | 10 | 16 | 20 | 142 | 111 | 165 |
| 81 | 10 | 16 | 20 | 143 | 113 | 166 |
| 82 | 10 | 15 | 19 | 144 | 114 | 167 |
| 83 | 10 | 15 | 19 | 145 | 115 | 168 |
| 84 | 10 | 15 | 19 | 147 | 116 | 170 |
| 85 | 10 | 15 | 19 | 148 | 117 | 171 |
| 86 | 10 | 15 | 19 | 149 | 118 | 172 |
| 87 | 10 | 15 | 19 | 150 | 119 | 173 |
| 88 | 10 | 15 | 18 | 151 | 121 | 174 |
| 89 | 10 | 15 | 18 | 152 | 122 | 175 |
| 90 | 10 | 14 | 18 | 154 | 123 | 177 |
| 91 | 10 | 14 | 18 | 155 | 124 | 178 |
| 92 | 10 | 14 | 18 | 156 | 126 | 179 |
| 93 | 10 | 14 | 18 | 157 | 127 | 180 |
| 94 | 10 | 14 | 18 | 159 | 128 | 182 |
| 95 | 10 | 14 | 17 | 160 | 129 | 183 |
| 96 | 10 | 14 | 17 | 161 | 131 | 184 |
| 97 | 10 | 14 | 17 | 162 | 132 | 185 |
| 98 | 10 | 13 | 17 | 164 | 133 | 187 |
| 99 | 10 | 13 | 17 | 165 | 134 | 188 |
| 100 | 10 | 13 | 17 | 166 | 136 | 189 |
| 101 | 10 | 13 | 16 | 168 | 137 | 191 |
| 102 | 10 | 13 | 16 | 169 | 138 | 192 |
| 103 | 10 | 13 | 16 | 170 | 140 | 193 |
| 104 | 10 | 13 | 16 | 172 | 141 | 195 |
| 105 | 10 | 13 | 16 | 173 | 142 | 196 |
| 106 | 10 | 12 | 16 | 174 | 144 | 197 |
| 107 | 10 | 12 | 15 | 176 | 145 | 199 |
| 108 | 10 | 12 | 15 | 177 | 147 | 200 |
| 109 | 10 | 12 | 15 | 179 | 148 | 202 |
| 110 | 10 | 12 | 15 | 180 | 150 | 203 |
| 111 | 10 | 12 | 15 | 182 | 151 | 205 |

TABLE 1-continued

| Velocity Factor | T1 | T2 | T3 | F1 | F2 | F3 |
|---|---|---|---|---|---|---|
| 112 | 10 | 12 | 15 | 183 | 152 | 206 |
| 113 | 10 | 11 | 14 | 184 | 154 | 207 |
| 114 | 10 | 11 | 14 | 186 | 155 | 209 |
| 115 | 10 | 11 | 14 | 187 | 157 | 210 |
| 116 | 10 | 11 | 14 | 189 | 158 | 212 |
| 117 | 10 | 11 | 14 | 190 | 160 | 213 |
| 118 | 10 | 11 | 14 | 192 | 161 | 215 |
| 119 | 10 | 11 | 14 | 193 | 163 | 216 |
| 120 | 10 | 11 | 13 | 195 | 164 | 218 |
| 121 | 10 | 11 | 13 | 198 | 168 | 221 |
| 122 | 10 | 11 | 13 | 201 | 171 | 224 |
| 123 | 10 | 11 | 13 | 204 | 174 | 227 |
| 124 | 10 | 11 | 13 | 208 | 177 | 231 |
| 125 | 10 | 11 | 13 | 211 | 180 | 234 |
| 126 | 10 | 11 | 12 | 214 | 183 | 237 |
| 127 | 10 | 11 | 12 | 224 | 193 | 247 |
| 128 | 35 | 90 | 150 | 110 | 88 | 133 |

What is claimed is:

1. A method for activating a solenoid in a player piano, comprising the steps of:

(a) translating a MIDI signal to a solenoid driving signal comprising a plurality of driving signal components; and (b) for each said driving signal component, activating a counter and energizing a solenoid while said counter is activated according to a duty cycle and time period corresponding to said driving signal component.

2. A method for activating a solenoid in a player piano, comprising the steps of:

(a) translating a MIDI signal to a solenoid driving signal comprising a plurality of driving signal components, each said driving signal component having an associated count value and duration value;

(b) for each said driving signal component, activating a counter and energizing a solenoid while said counter is activated for a period of counts equal to said associated count value; and (c) for each said driving signal component, repeating step (b) until said until said duration value has been exceeded.

3. A method for activating a solenoid in a player piano, comprising the steps of:

(a) translating a MIDI signal to a solenoid driving signal, said driving signal comprising a plurality of driving signal components, each said driving signal component having an associated count value and duration value; and (b) for each said driving signal component, (i) activating a counter, said counter having a count range from 0 to 255;

(ii) activating a solenoid during the period that said counter is counting from zero to said count value;

(iii) deactivating said solenoid during the period from said count value plus one through 255; and (iv) repeating steps (i) through (iii) until said duration value has been exceeded.

4. An apparatus for activating a solenoid in a player piano, comprising:

(a) means for translating a MIDI signal to a solenoid driving signal comprising a plurality of driving signal components; and (b) means for activating a counter and energizing a solenoid while said counter is activated according to a duty cycle and time period corresponding to each said driving signal component.

5. An apparatus for activating a solenoid in a player piano, comprising:

(a) means for translating a MIDI signal to a solenoid driving signal comprising a plurality of driving signal components, each said driving signal component having an associated count value and duration value;

(b) for each said driving signal component, means for repeatedly activating a counter and energizing a solenoid while said counter is activated for a period of counts equal to the said associated count value until said associated duration value has been exceeded.

6. An apparatus for activating a solenoid in a player piano, comprising:

(a) means for translating a MIDI signal to a solenoid driving signal, said driving signal comprising a plurality of driving signal components, each said driving signal component having an associated count value and duration value; and (b) for each said driving signal component, means for repeatedly (i) activating a counter, said counter having a count range from 0 to 255, (ii) activating a solenoid during the period that said counter is counting from zero to said count value, and (iii) deactivating said solenoid during the period from said count value plus one through 255 until said duration value has been exceeded.

* * * * *